United States Patent [19]

Galtier et al.

[11] Patent Number: 4,695,370

[45] Date of Patent: Sep. 22, 1987

[54] PROCESS AND APPARATUS FOR FLUID BED CATALYTIC CRACKING

[75] Inventors: Pierre Galtier, Vienne-Estressin; Christian Busson, Dardilly, both of France

[73] Assignee: Institut Francais du Petrole, Rueil-Malmaison, France

[21] Appl. No.: 762,073

[22] Filed: Aug. 2, 1985

[30] Foreign Application Priority Data

Aug. 2, 1984 [FR] France ..... 84 12388

[51] Int. Cl.[4] ..... C10G 11/18

[52] U.S. Cl. ..... 208/113; 208/120; 422/140; 422/144; 422/145; 422/147

[58] Field of Search ..... 422/140, 144, 145, 147; 208/113, 120, 148, 161, 164; 34/10, 57 A

[56] References Cited

U.S. PATENT DOCUMENTS

| | | | |
|---|---|---|---|
| 2,607,662 | 8/1952 | Huff | 34/57 A |
| 2,850,808 | 9/1958 | Jones et al. | 34/57 A |
| 2,965,454 | 12/1960 | Harper | 422/144 |
| 3,152,065 | 10/1964 | Sharp et al. | 422/214 |
| 3,246,960 | 4/1966 | Sharp et al. | 422/214 |
| 3,835,029 | 9/1974 | Carson | 422/214 |
| 4,385,985 | 5/1983 | Gross et al. | 208/113 |
| 4,514,285 | 4/1985 | Niccum et al. | 422/144 |

*Primary Examiner*—Barry S. Richman
*Assistant Examiner*—William R. Johnson
*Attorney, Agent, or Firm*—Millen & White

[57] ABSTRACT

A fluid bed catalytic apparatus and process for cracking a hydrocarbon charge and regenerating the catalyst where hot particles are contacted at the top of the cracking zone (1) with the sprayed liquid charge to be treated and thus produce (a) the vaporization of the charge in lines 10 and (b) an intimate charge-catalyst particles mixture. The catalyst particles are then withdrawn from the lower part of the cracking reactor (1), separated from the reaction effluent, stripped in reactor (17) and successively subjected to two regeneration steps, respectively in zones (22) and (37), zone (37) being a tubular reactor where the catalyst particles are driven upwardly by a carrying gas.

17 Claims, 3 Drawing Figures

PROCESS AND APPARATUS FOR FLUID BED CATALYTIC CRACKING

The invention relates to a new process for (a) catalytically cracking more particularly heavy hydrocarbon oils and (b) regenerating the catalyst, as well as to the apparatus for carrying out this process.

BACKGROUND OF THE INVENTION

Changes in the nature of the crude oil supply as well as the decrease of the demand for refined products and fuel oils, in the favour of lighter products of the gasoline type, have led the oil refinery industry to develop various processes in view of upgrading natural heavy oils as well as residual oils such as straight-run distillation residues or vacuum distillation residues.

As concerns the catalytic cracking processes for treating such charges, it appears that main difficulties arise from the fact that these charges contain organic substances such as asphaltenes as well as condensed polycyclic aromatic hydrocarbons which are difficult to crack to lighter molecules in order to obtain substantial yields of fractions of lower boiling points, and tend to combine with each other to produce substantial coke formations, depositing on the used catalysts, thus decreasing their activity. Moreover, the presence in these heavy oils of substantial amounts of heavy metals such for example as nickel, vanadium, iron etc. . . . is considered as detrimental, since these metals tend to poison or at least to deactivate the catalysts of the zeolite type, generally used in the fluid bed catalytic cracking, hereinafter called F.C.C.

A number of essential factors may however make possible to convert heavy products to lighter fractions with a good selectivity, while maintaining the coke formation to a minimum.

Among these factors, one of the most important consists of ensuring, at the level of the contact with the hydrocarbon charge —generally preheated and with steam addition—with the hot regenerated catalyst used in the catalytic cracking unit, such a mixing that heat transfer between the charge and the catalyst takes place as quickly and as regularly as possible. It is also of high importance to renew permanently and efficiently the regenerated catalyst at the level of the charge introduction in the reaction zone, particularly by avoiding backmixing phenomena which increase the contact time and result in a substantial decrease in the formation of light cuts while increasing the weight proportion of coke formed on the catalyst particles.

Another important phenomenon, also detrimental to a good operation of a F.C.C. unit, more particularly destined to the treatment of heavy charges, consists in the difficulty of obtaining a good radial homogeneity of the catalyst, as well at the inlet as through the reaction zone.

Concerning the selectivity of the cracking reactions generally, it is known that it is better as the flow of fluids is more similar to piston flow, which is particularly difficult to obtain in F.C.C. conventional units.

OBJECTS OF THE INVENTION

The present invention has for object to simultaneously achieve the best conditions to have the benefit of the three above-mentioned factors: absence of backmixing, radial homogeneity and piston-like flow. These objects can be attained by simultaneously using a new type of charge injection and of mixing with the catalyst, a reaction zone where through the charge and the catalyst flow downwardly in co-current, and a quick separator.

Among the F.C.C. processes disclosed in the prior art and using a reactor with downward co-current in the reaction zone, some of them are destined to treat conventional charges such as vacuum gas-oils. U.S. Pat. No. 2,420,558 discloses such a method but uses a conventional system of charge injection and a single catalyst regeneration zone. The U.S. Pat No. 2,965,454 discloses an apparatus whose reaction zone consists of a plurality of vertical tubes wherethrough the charge and the catalyst flow downwardly as co-currents. U.S. Pat. No. 3,835,029 also concerns a F.C.C. process with downward co-currents which is applied only to light charges—entirely vaporizable between 510° and 550° C.—which are introduced below the catalyst inlet in the reaction zone, when the catalyst velocity ranges from 9 to 30 m/s, and which is not provided with a quick gas/-solid separation system.

These methods are not convenient for heavier hydrocarbon charges requiring a special apparatus for vaporizing and injecting said charges, and, usually, a two-step catalyst regeneration process for conveniently regenerating the catalyst.

U.S. Pat No. 4,385,985 discloses an improved catalytic cracking process with downward flow for treating heavy charges whose final boiling point is higher than 560° C. and having a Conradson carbon content of at least 3%. However, in the described system, as concerns the mixture of regenerated catalyst with the charge, wherein the catalyst is introduced through a perforated grid and the charge is introduced through a conventional system of several injectors located below the point of introduction of the regenerated catalyst, an ultra-rapid vaporization of the charge homogeneous mixture over the whole reactor section cannot be achieved. The same is true for the system, with an identical apparatus, disclosed in U.S. Pat. No. 4,411,773, at least as far as the essential part, particularly the mixing-injection system, is concerned.

Many specific techniques have been already described for introducing a heavy hydrocarbon charge in the reaction zone of a catalytic cracking reactor. For example, U.S. Pat. No. 4,097,243 discloses a charge distributing system comprising a plurality of injection nozzles provided on the wider section of a cone frustum, certain nozzles being parallel to the reactor axis and the others inclined with respect to said axis, the regenerated catalyst being supplied in an oblique direction with respect to the reactor axis, above the system for introducing the charge. U.S. Pat. No. 4,427,737 discloses a method for preparing and dispersing heavy charges. This method consists of first forming an emulsion of the charge in water, preheating said emulsion before spraying it as droplets of 100 to 500 microns, this spraying being achieved outside the reaction zone, by means of a gas diluent. The injection in the reaction zone is performed through a plurality of nozzles distributed on a frustro-conical distributor whose area is only from 20 to 40% of that of the "reactor". According to this process, the regenerated catalyst is supplied below the system of charge injection, the charge being introduced at a velocity higher than 90 m/s. U.S. Pat Nos. 3,152,065 and 3,246,960 teach a method for injecting a hydrocarbon charge in the lower part of a "reactor" so as to introduce a mixture of charge with steam, the charge being subjected to a helical motion before being admixed with steam, and then the whole mixture being passed through an orifice of limited cross-sectional area, the regenerated catalyst being supplied below the injection system, at the base of the "reactor".

However none of the above-mentioned devices makes it possible to achieve a convenient injection of heavy hydrocarbon charge in a catalytic cracking reaction zone, while simultaneously providing for a quick mixing—preferably in less than 500 milliseconds—of the catalyst and the vaporized charge, and a good radial homogeneity of the mixture along the whole reactor surface.

In addition these devices are provided for introducing charges in F.C.C. reactors of the ascending co-current type and are not adapted to the downward co-currents of catalyst and charge.

SUMMARY OF THE INVENTION

The invention thus relates to a new F.C.C. (fluid catalytic cracking) process, more specially useful for converting heavy hydrocarbon charges. As a matter of fact, these charges may be either conventional charges, i.e. having for example a final boiling point of about 400° C., such as vacuum gas-oils, but also heavier hydrocarbon oils, such as crude and/or stripped oils, straight-run or vacuum distillation residues. These charges may have been optionally subjected to a preliminary treatment, such for example as a hydro-treatment in the presence, for example, of catalysts of the cobalt-molybdenum or nickel-molybdenum type. The preferred charges according to the invention are those containing fractions having normal boiling points up to 700° C. and more, optionally containing high proportions of asphaltene products and having a Conradson carbon content up to 4% or more. These charges may be diluted or not with conventional lighter cuts which may include hydrocarbon cuts already subjected to cracking, which are recycled, as, for example, light cycle oils (LCO) or heavy cycle oils (HCO). According to a preferred embodiment of the invention, these charges are preheated in a temperature range from 300° to 450° C. before being treated.

More specifically, the invention consists of introducing the charge in the upper part of a substantially vertical reaction zone, by means of a system for injecting and dispersing the charge, generally with additional steam, whereby it is sprayed to droplets of an average size, preferably not in excess of 100 microns and more particularly of about 50 microns, the velocity of the charge, at the level of its injection, being preferably from 10 to 100 m/s. This device comprises a plurality of injection nozzles, each of these nozzles being placed in the upper part of a discharge tube for the regenerated hot catalyst, co-axially with this tube, so as to obtain, in the upper part of the discharge tube substantially parallel flows of the partially vaporized charge jets, on the one hand, and, of the hot catalyst particles, on the other hand, thus favouring heat exchanges by radiation between these two flows in this part, the complete vaporization of the charge being achieved in the lower part of said catalyst discharge tubes. According to this device, the contact-time between charge and catalyst, generally does not exceed 500 milliseconds and is generally of about 100 milliseconds. The co-current of charge (thus vaporized) and catalyst then flows downwardly through the reaction zone where the temperature is generally from 450° to 700° C., the residence-time being from 0.1 to 10 seconds, preferentially from 0.2 to 4 seconds. At the lower part of the reactor, the co-current of catalyst and reaction effluent already subjected to cracking treatment, is speeded up and then passes through an original quick separation system (see hereinafter the explanation of FIG. 3) which achieves a first separation of the vapors from the catalyst particles in a time of less than one second; 50 to 90% of the catalyst particles are thus separated from the gaseous reaction effluent, the separation being completed by means of one or more conventional cyclones. The invention thus provides for a rapid and thorough separation between the catalyst and the gaseous effluent (made possible by the use of cyclone (s) of the so-called reverse flow type with reversal of the spiral obtained by the effluent motion) but also for a very quick separation of the catalyst from the effluent, since 50 to 90% of the catalyst particles are separated from the gaseous effluent by the previous use, before a more complete separation, of at least one uniflow cyclone of very short residence time, with helical flow of the obtained vapors and without reversal of the spiral. The effluent gases are separated and the catalyst then passes to a stripping zone where it is treated by such gases as steam and/or inert gases such as CO, $C0_2$, combustion gases or fuel-oil gases; the hydrocarbons and the stripping gases are discharged and the so-stripped catalyst is then conveyed, in fluidized form, to the first regeneration zone, substantially vertical, where the temperature is maintained within about 500°–700° C. In said first regeneration zone, oxygen and/or a molecular oxygen-containing gas is introduced, preferably as air, in such an amount that the combustion of hydrogen of the products deposited on the catalyst is substantially complete, or at least of 90% by weight. Only a part of the carbon of the products deposited on the catalyst is also oxidized, so that 10 to 60% by weight of the carbon initially present is oxidized, essentially to CO; the effluent gases from the first regeneration zone, separated from the catalyst partially regenerated in the cyclones, thus have, in view of the relatively low amount of oxygen used and of the temperature at which the operation is conducted, a particularly high CO content. The partially regenerated catalyst is then conveyed to a second regeneration zone, by means of an additional supply of an anhydrous oxygen-containing gas, such, for example, as dry air.

This second regeneration zone consists of a substantially vertical reactor, of a length L much greater than its diameter $\phi$, such that the ratio $L/\phi$ be from 3 to 90, internally lined with refractory materials. The partially regenerated catalyst is introduced at the base of the second regeneration zone. The temperature at which said second regeneration takes place is higher than that of the first one; it is usually higher than 650° C. and may reach 1000° C. Said second catalyst regeneration step is conducted in the presence of a large oxygen excess (preferably dry air) and the formed gases have particularly high $C0_2$ contents. There is thus obtained a catalyst free of the most part of carbon which was deposited on its surface, since the coke proportion by weight with respect to the catalyst is generally lower than 0.04%. The so-regenerated catalyst is separated from the gaseous stream by cyclones outside the second regeneration zone; it is then at a temperature generally from 600° C. (or even 700° C.) to 950° C., and is brought back to the contactor-mixer through downwardly extending legs provided with flow control valves.

The F.C.C. process of the present invention may be used with any conventional catalyst generally used in this technique; however, catalysts of zeolite base are preferred and, among them, those having a good thermal stability, particularly in the presence of steam, although said stability at high temperature, in the presence of moistness, is not a major condition, in view of the system of double catalyst regeneration. As a matter of fact, the second regeneration step, conducted at high temperature, is performed under substantially anhydrous conditions, in view of the fact that the almost entire hydrogen amount contained in the very heavy hydrocarbon molecules deposited on the catalyst during the cracking reaction is converted to steam during the first regeneration step, conducted under relatively smooth temperature conditions. Generally, the catalyst, and the output of the first regeneration step, contains a proportion of deposited carbon generally from 0.8 to 5.4% by weight and the remaining hydrogen proportion at this stage, is often practically zero.

According to particular embodiments of the present invention, injections of dry oxidizing gas (generally anhydrous air) may be performed, if so desired, at various points along the combustion zone, formed by the second regenerator at high temperature, so as to always maintain a large excess of oxygen with respect to the carbon remaining to burn.

The simultaneous use of various devices according to the invention i.e.: system for injecting and dispersing the charge at the level of the hot regenerated catalyst supply, reaction zone traversed downwardly by a cocurrent of catalyst and charge, quick separation of the catalyst from the products, and catalyst regeneration in two separate steps, provide for a substantially increase of the yield to light fractions, and specially to a gasoline cut which has a good octane number.

The improvement in the radial distribution of the catalyst, the absence of backmixing, the flow of fluids more similar to piston flow, the quick separation of the catalyst from the products, the selectivity increase, reduce the coke and gas formations and makes it possible to reduce the volume of the reaction zone, thereby reducing the investment cost as well as the catalyst investment.

The invention concerns a process for (a) fluid catalytic cracking of a hydrocarbon charge in a reaction zone (1) wherein the charge and the catalyst flow cocurrently, downwardly and for (b) regeneration of the catalyst in two regeneration zones (22) and (37).

Figure 1:
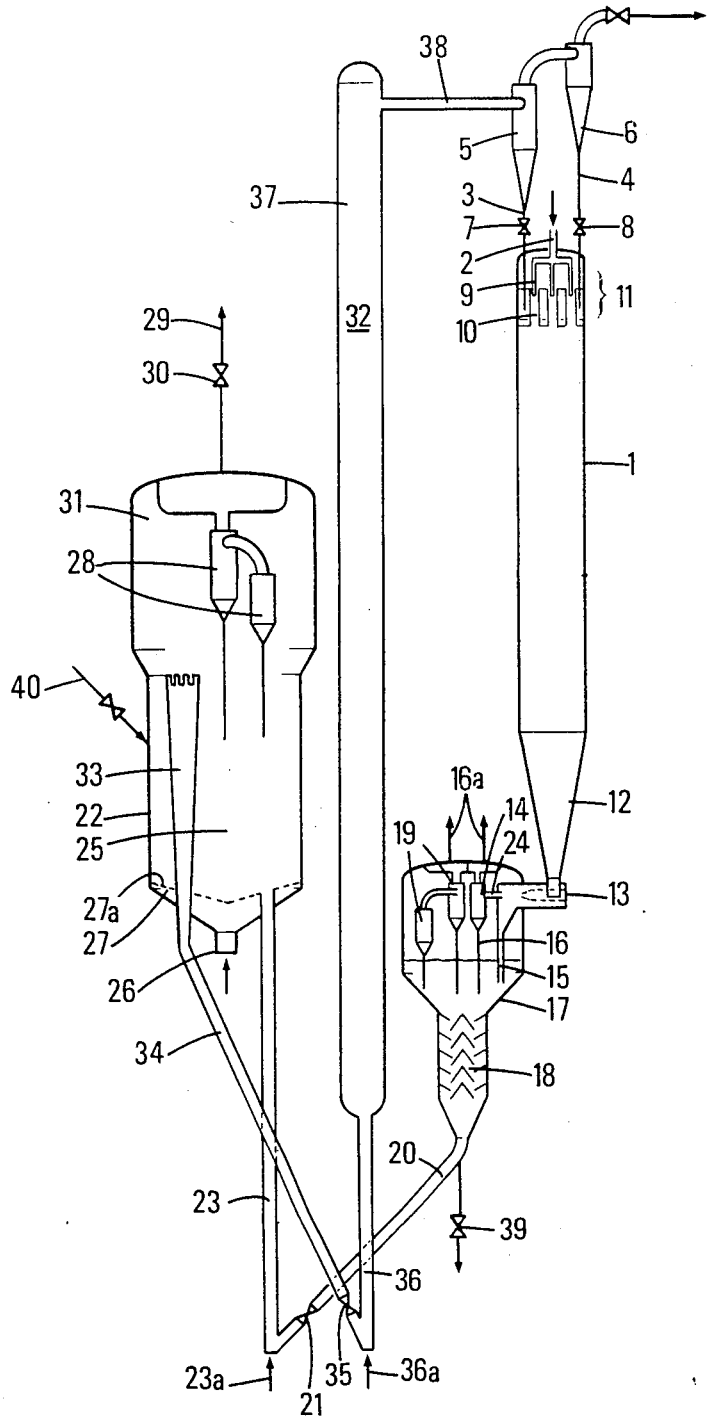
FIG. 1 diagrammatically illustrates a possible embodiment of a F.C.C. unit according to the invention.

The process comprises the steps of (see FIGS. 1 or 2):

injecting the liquid charge in the upper part of the reaction zone (1) through at least one line (2) subdivided into a plurality of substantially vertical ducts (9) each provided, at its lower end with a means (114 in FIG. 2) for spraying the charge as droplets of average size preferably of at most 100 microns and more particularly about 50 microns, the velocity of the charge, at the level of the spray points, being preferably from about 10 to 100 m/s.

introducing, in an enclosure at the upper part of the reaction zone (1), catalyst particles at a temperature of 600°-950° C., originating, as mentioned hereinafter, from a regeneration zone (37), through at least one line (3) or (4), so as to form in said enclosure a catalyst fluid bed, passing through said catalyst bed an upward gas flow so as to drive therewith the catalyst particles downwardly through a plurality of substantially vertical discharge lines (10) thereby conveying the catalyst particles to the reaction zone itself, each vertical line (9) for injecting the charge having the same axis as a catalyst discharge line (10), each means for spraying the liquid charge being located in the vicinity of the upper end of a discharge line, in order to obtain in said discharge lines (10) a flow of charge and a flow of catalyst particles for completely vaporizing the liquid charge and intimately admixing the charge with the catalyst particles, the contact time, in a discharge line, between the charge and the catalyst particles being preferably shorter than 500 milliseconds and more particularly shorter than 100 milliseconds, maintaining in contact, in the reaction zone itself, at 450°-700° C., the charge and the catalyst, with a residence time of the charge from 0.1 to 10 seconds and preferably from 0.2 to 4 seconds, increasing the velocity of the catalyst and of the reaction effluent in the lower part (12) of the reaction zone, said lower part of the reaction zone consisting of at least one funnel, shaped as a cone frustrum or a pyramid frustrum or having any other equivalent shape, with the tip down and whose half apex angle ranges from about 5° to 30° and preferably from 7° to 15°, separating 50 to 90% of the catalyst particles from the reaction effluent in at least one first separation zone (13) providing for a residence time shorter than one second, the gaseous effluent velocity at the inlet of said separation zone being from 10 to 40 meters per second, so as to produce a helical vapor flow without reversal of the generated spiral, the major part of the remaining catalyst particles, driven along with the gaseous effluent, been then separated from the reaction effluent in at least one other separation zone (14) of the reverse flow type, i.e. with reversal of the spiral generated by injection of the gaseous flow in said other separation zone, removing from the catalyst particles the major part of the hydrocarbons of the effluent driven along therewith, by stripping with a gas, upwardly conveying the catalyst particles (which are at this stage at a temperature of at least 450° C.) by means of a gas, brought at a temperature of 150°-300° C., through a line (23) feeding these catalyst particles to a first regeneration zone (22)

performing a first catalyst regeneration step, in fluidized (or dense) bed, at a temperature $T_1$ ranging from about 500° to 750° C., in the presence of oxygen or of molecular oxygen-containing gas, so as to produce a combustion of at least 90% of the hydrogen and preferably of substantially the whole hydrogen amount contained in the products deposited on the catalyst and to oxidize, in major part to CO, from 10 to 60% by weight of the carbon present, as carbonaceous compounds, on the catalyst, removing the major part of the gases present in the first catalyst regeneration zone, withdrawing the partially regenerated catalyst from the first regeneration zone and conveying it upwardly through a line (36) by means of a gas carrier of oxygen base or a molecular oxygen-containing gas, substantially free of steam, to the upper part of a second regeneration zone, shaped as a substantially vertical and elongate tubular zone (37) whose ratio $L/\phi$ (wherein L is the tube length and $\phi$ its diameter) ranges from 3 to 90, said catalyst being treated in the second regeneration zone by a regeneration gas containing molecular oxygen, substantially free of water, at a temperature $T_2$, from 650° to 1000° C., $T_2$ being higher than $T_1$, in view to obtain a regenerated catalyst containing no more than 0.04% by weight of coke, with the production of gas of high $C0_2$ content, so that the catalyst is driven upwardly through the regeneration zone (37) by means of said gas carrier during said second regeneration, and withdrawing from the second regeneration zone (37) a gas-catalyst mixture, separating the catalyst particles from the gases and feeding back said regenerated particles, whose temperature, at this stage, ranges from 600° to 950° C., to the catalytic cracking reaction zone (1) through at least one duct (3) or (4).

Figure 2:
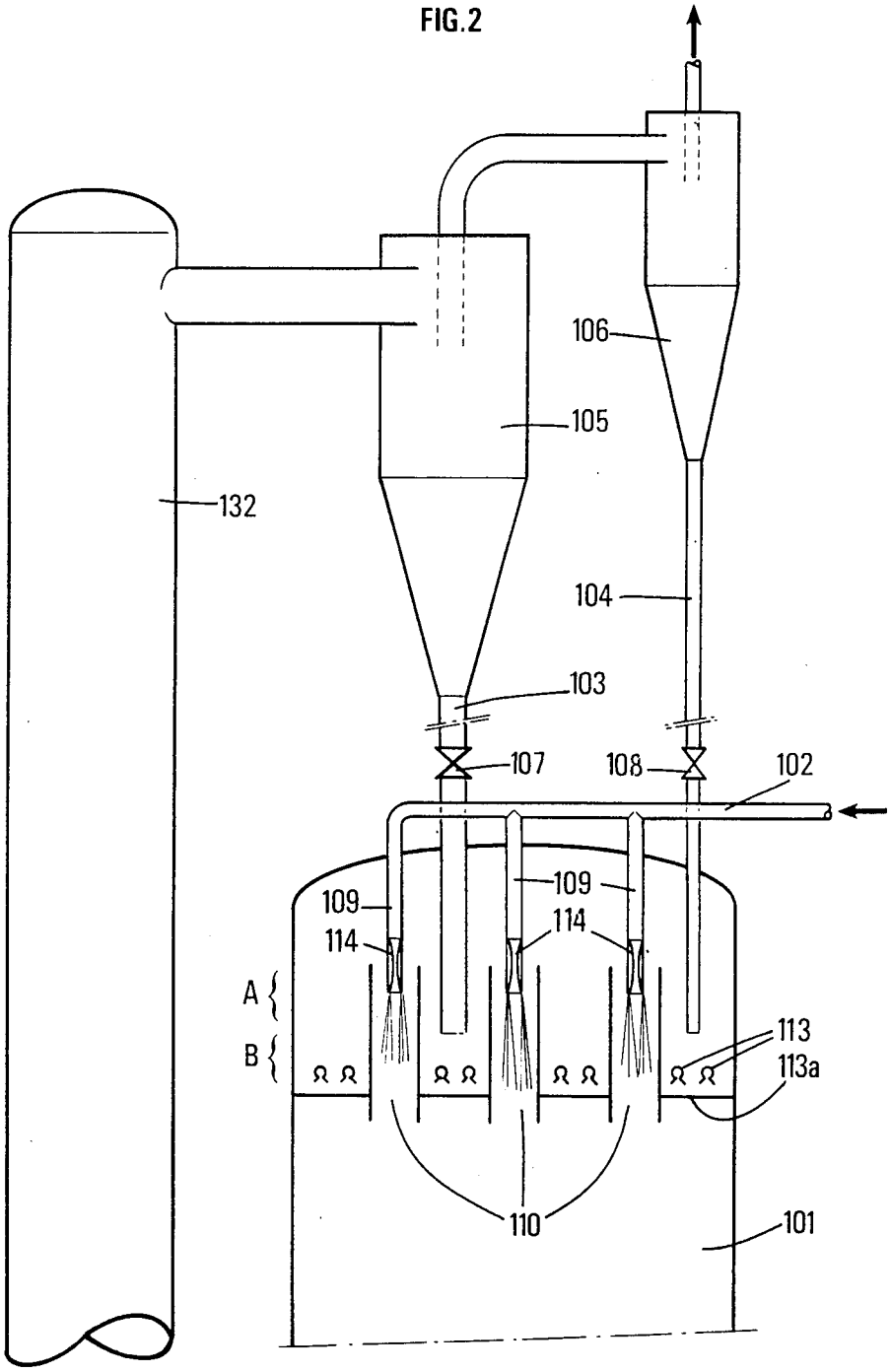
FIG. 2 is a more detailed view of a preferred embodiment of the device for injecting and dispersing the charge.

The invention also concerns an apparatus for catalytic cracking and catalyst regeneration which comprises (see FIGS. 1 and 2):

an elongate, substantially vertical reactor (1), at least one admission line (2) for liquid charge, at the upper part of the reactor, said line being subdivided into a plurality of ducts (9) substantially vertical, having each, at its lower end, a spray nozzle for injecting said charge (114 in FIG. 2), at least, two substantially vertical legs (3) and (4), generally equipped with valves (7) and (8) for introducing catalyst particles into a reservoir or enclosure at the upper part of reactor (1), above the horizontal wall (113-*a* in FIG. 2).

at least one distributor (113 in FIG. 2) for a gaseous fluid, in the vicinity of the horizontal wall (113-*a* in FIG. 2), a plurality of tubes (10) for discharging catalyst particles from said reservoir into the reactor itself, said discharge tubes being so arranged that each charge admission duct (9) has the same axis as one discharge tube (10) and so that each charge injection nozzle is in the vicinity of the upper end of a discharge tube (10), the assembly of the nozzles (9) and the discharge tubes (10) thus forming a contact and mixing zone between the charge and the catalyst, a bottom of reactor (1) comprising at least one funnel shaped as a cone frustrum or a pyramid frustrum or of any equivalent shape, with the tip down and whose half apex angle is from 5° to 30°, preferably from 7° to 15°, at least one primary separation zone (13) comprising one or more uniflow cyclones, with direct passage, without reversal of the spiral of the catalyst particles of the reaction effluent, said first zone being for example outside the reactor, the catalyst particles being withdrawn from said primary zone through at least one leg (15) for example substantially vertical, at least one secondary separation zone (14) wherein are separated from the reaction effluent, the major part of the remainding catalyst particles driven along therewith, the catalyst particles being withdrawn from said secondary zone through at least one leg (16) preferably substantially vertical, the reaction effluent being withdrawn through at least one line (16-*a*), a reactor or zone (17) for stripping catalyst particles by means of a gas introduced through at least one line (221 in FIG. 3), said zone (17) being fed with catalyst through legs such as (16) and (15), a leg (20) for discharging catalyst particles to the outside of said zone (17), said leg (20) being generally equipped with a valve (21), a substantially vertical line (23) to lift the catalyst particles supplied through leg (20), by means of a lifting gas introduced through line (23*a*) so as to convey the catalyst particles into a first regeneration reactor (22), a first regeneration reactor (22) comprising a grid or any other equivalent means (27*a*) to support a catalyst bed (25), a feeding line (26) for oxygen or molecular oxygen-containing gas supply, a device (28) consisting of at least one cyclone for separating gases from the catalyst particles, a gas discharge line (29) generally provided with a valve (30) and a duct (33) for withdrawing the catalyst from zone (22), a leg (34) for the catalyst downward flow, communicating with said duct (33) and generally equipped with a valve (35), an ascending vertical catalyst duct (36), said duct (36) being fed with a conveying or lift gas introduced through line (36 *a*), a substantially vertical tubular catalyst regeneration reactor(37) whose ratio $L/\phi$ (L being the length of the tubular reactor and $\phi$ its diameter), ranges from 3 to 90, the reactor being equipped with at least one nozzle for injecting a regeneration gas, a gas-catalyst mixture discharge line (38), means (5 and 6) for separating the catalyst from the gases, consisting of at least two separators of cyclone type, generally placed outside the regeneration reactor (37) and the reactor (1), the catalyst withdrawn from said separators being supplied to the reactor through feeding ducts (3) and (4).

According to FIG. (1) illustrating one of the possible embodiments of the present invention, a hydrocarbon charge, for example a gas-oil or a hydrocarbon of high boiling point, is introduced through line (2) at the top of the vertical reactor (1) A catalyst regenerated at high temperature is also introduced at the top of reactor (1) through the downwardly extending legs (3) and (4) of external cyclones (5) and (6), equipped with valves (7) and (8) to control the rate of the flow. The hydrocarbon charge is sprayed and partially vaporized in a multinozzle injection system (9), an embodiment of which is described more in detail in FIG. 2. In a preferred embodiment, the charge is then quickly dispersed and admixed with the hot catalyst in a plurality of discharge tubes (10) of the downwardly extending multinozzle quick contactor-mixer (11), an embodiment of which is illustrated more in detail in FIG. 2. At the output of the contactor-mixer (11), wherein ultra-rapid heat transfers are achieved between the regenerated catalyst at high temperature and the charge, the latter is completely vaporized and the heavy fractions thereof thermally disintegrated by the effect of the so-achieved initial thermal shock. In this device for a convenient quick mixing, the charge-catalyst contact time is generally at most 500 milliseconds and preferably shorter than 100 milliseconds.

After admixture, the temperature reached by the hydrocarbons vapor/catalyst suspension may vary within the temperature range of 450°–700° C., in relation with the desired conversion rate and the composition of the charge. The hydrocarbons vapor/catalyst suspension then flows downwardly vertically through reactor (1) whose cross-section may progressively vary to comply with the required operating temperature and residence-time conditions. The suspension at high temperature, consisting of the formed hydrocarbon vapors, the dilution gases and the driven catalyst, passes through the reactor at a velocity corresponding to flow conditions close to piston flow. The downward flow has in particular the advantage of noticeably decreasing the relative slipping of the catalyst with respect to the carrier gas. The residence-time of the hydrocarbon charge in the reaction zone (1) is about from 0.1 second to about 10 seconds, preferentially from about 0.2 seconds to 4 seconds. In order to still increase the catalyst retention and hence to decrease the total reaction volume, the reactor (1) may be internally provided with baffles or packing (not shown) such as Rasching rings, Berl saddles, Intalox saddles etc. . . .

Figure 3:
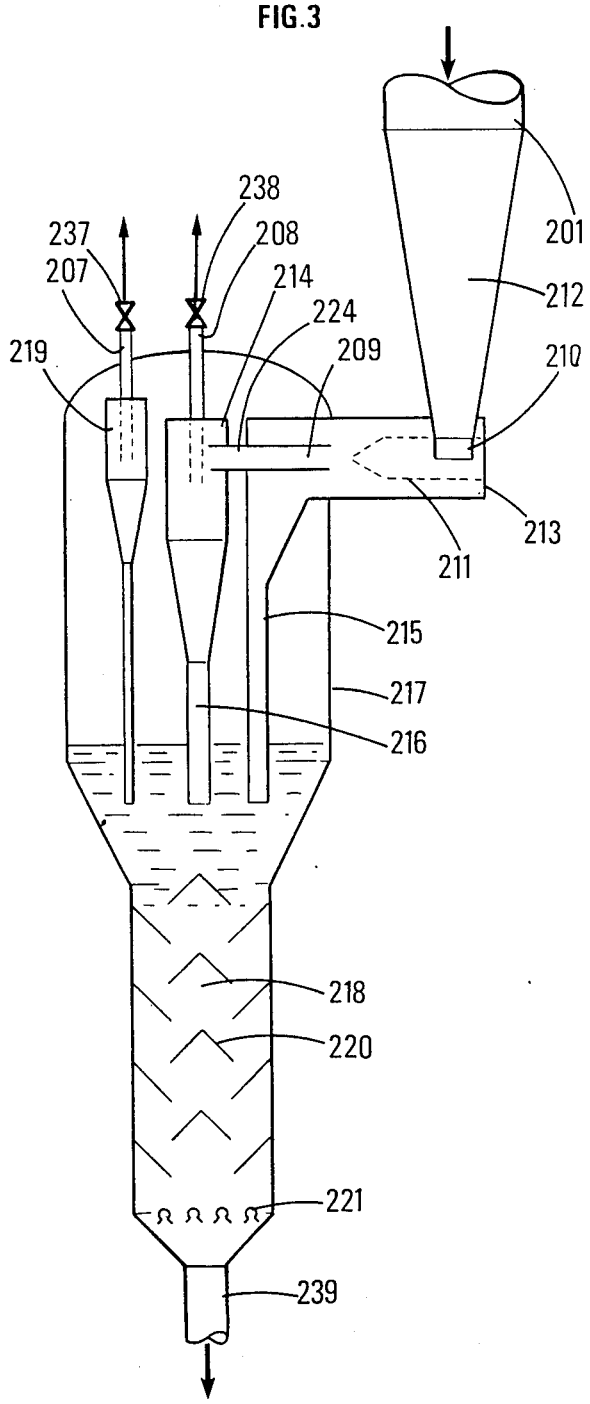
FIG. 3 is a detailed view of the quick release device and of the stripping reactor at the outlet of the cyclones for separating gases and catalyst particles from the mixtures withdrawn from the F.C.C. reactor.

The hydrocarbons vapor/catalyst suspension is then quickened in one or more convergent systems of conical or pyramidal or equivalent shape (12) whose half apex angle ranges from 5° to 30°, preferably from 7° to 15°, wherefrom it enters a separator 13 (or several separators in parallel) for a residence-time shorter than 1 second. Said quick separation may be obtained in a preferred way by means of one cyclone (or several cyclones in parallel) without spiral reversal of the so-called uniflow type, with direct passage. FIG. 3 shows in detail one of these possible embodiments, where a cyclone of the uniflow type is arranged horizontally. This first stage provides in a very short time (<1 second) a relatively rough first separation (but with efficiencies higher than 50%). The effluent passes through said uniflow cyclone, without reversal of the generated spiral, and flows out into one or more stages, in parallel or in series, of secondary separation (14), by conventional so-called reverse flow cyclones, known in the art, which provide for a very complete separation of the catalyst, still driven along with the output effluent from the first quick separation stage (13). The reaction effluent is discharged through line 16 bis. The catalyst is discharged through the downwardly extending legs of the primary (15) and secondary (16) separation train, inside a reactor (17) where the hydrocarbons driven along with said solid powders are stripped, generally with steam. This configuration makes possible a completely external location of reactor (1) which facilitates the maintenance of the reaction section.

The lower section of reactor (17) has generally a smaller diameter than that of the upper section and contains a stripping zone (18) at the bottom of which a suitable stripping gas such as steam, inert gases (CO, $C0_2$, . . .), combustion gases or fuel gases, is introduced. A conventional primary and secondary separation system (19) is used in the upper section of reactor (17) for separating the stripped hydrocarbon products and the stripping gas from the catalyst particles. The stripping gases and the stripped hydrocarbons flow out of separator (19) through outlet pipes, not shown. According to a possible alternative embodiment, when the upper part of the stripping reactor (17) is too small to contain an additional separation system (19), the stripping effluents may be treated with the effluents directly issued from the reactor, in the single separation train (14), sequential or parallel, with the optional omission in this embodiment of the direct connection (24) between the primary separation (13) and said separation train (14). This stripping operation is conventional in the art, and needs no further description.

After stripping, the catalyst is covered with a coke deposit. It is withdrawn from the bottom of the stripping reactor (17) at a temperature of at least 450° C., through a discharge leg (20) equipped with a valve (21) for controlling the flow of solid particles. This discharge leg (20) closely filled with solid particles, is of sufficient height so that the formed plug of solids acts as a joint and provides for the balancing of the respective pressures in the reaction section and in the next regeneration stages.

After being stripped, the catalyst, still covered with coke deposits, is transferred from the discharge leg (20) to the bottom of the first regeneration stage (22), by means of a conveying gas, to the foot of a substantially vertical lift (23). An optional purge may be effected through valve (39). This conveying gas (line 23 *a*) may consist of preheated air, overheated steam, hot oxygen additions, at temperatures from 150° to 300° C., under about 2–3 bars. The amount of conveying gas introduced in said lift is sufficient to form with the catalyst a solid/gas suspension, whose density is such that it is compelled to flow upwardly through line (23), wherefrom it is discharged in the lower part of the first regeneration stage (22).

The first regeneration stage of the catalyst consists of a dense fluidized bed (25), according to a technology known in the art, which needs not to be described more in detail here.

A gas of high oxygen content, necessary for the catalyst regeneration, is introduced at the bottom part of the fluidized bed (25) through line (23) and/or through line (26) connected to a gas distributor (wall 27*a* of the grid or perforated tubes type) (perforations 27).

A primary and secondary (28) cyclonic separation systems are arranged in the upper part (31), flared, of reactor (22) for separating the catalyst particles, driven along, from the combustion gases of high CO content. The regeneration gases of high CO content are extracted from reactor (22) through a line (29) equipped with a valve (30) for controlling the pressure.

The first regeneration step conducted in reactor (22) is performed under relatively mild temperature conditions, below 750° C. and with reduced oxygen concentrations, so selected as to obtain the combustion of at least 50% of the hydrogen (preferably substantially 100%) contained in the coke deposit formed on the catalyst and burn a part of the carbon (10–60% by weight of the carbon present). The operating conditions and the oxygen concentration are sufficient to maintain the temperature of the dense fluidized bed (25) within about 500°–750° C. These relatively mild regenerating conditions are used in order to avoid the presence of steam during hydrogen combustion which would substantially reduce the catalyst activity. Thus, the first regeneration stage, at a temperature considered as relatively low, generates combustion gases of very high CO content. CO post-combustion in the dense fluidized bed (25) in the release zone and in the cyclonic separation system (28) are thus avoided. A CO heater (not shown) is provided downstream of the discharge line (29) to generate pressurized steam while converting CO to $C0_2$. A power recovery unit may also be provided before said CO combustion step, according to conventional techniques known in the art.

Thus, the first regeneration step may be conducted at such a temperature, pressure and reduced $0_2$ concentration, that a certain proportion of coke of low hydrogen content is left on the catalyst before being finally burnt in a second regeneration stage at high temperature (32). It is recommended to reduce the carbon combustion in the first regeneration stage at a relatively low temperature, lower than 750° C., to the amount just required for the combustion of a substantial part of the hydrogen.

The partially regenerated catalyst, whose residual coke is practically free of hydrogen or only contains a few hydrogen, is extracted from the dense fluidized bed (25) through a withdrawing duct (33) communicating with an external, incurved, downwardly extending leg (34) equipped with a valve (35) controlling the flow of solids. This downwardly extending leg (34), wherethrough is maintained a dense flow of powdery solids, opens in an ascending vertical duct (36) at the foot of which is introduced a conveying gas in such an amount that the difference of density in lines (36) and (34) results in the upward flow of these solids through line (36). This conveying gas is an oxygen-containing non combustible gas, usually air; it must be preferably completely free of steam.

The catalyst, as a bed driven by the oxygen-containing conveying gas, enters a separate reactor (37), preferably provided with inner refractory lining, where takes place a second separate regeneration step at high temperature, conducted at a temperature higher than 650° C., substantially in the absence of steam. The oxygen amount is sufficient to maintain a high temperature of regeneration by coke combustion, combined with the substantially complete combustion of CO to $C0_2$. The regeneration at high temperature, by combustion of all the residual carbon, is not limited in temperature and may reach 1000° C. Thus the temperature of the second regeneration stage is free to reach the required level for practically removing all the residual coke deposited on the catalyst particles, so as to obtain a reduced coke content by weight of the catalyst, of less than 0.04%. This second separate regeneration step at high temperature is performed in an ascending vertical tubular reactor (37). The used catalyst is conveyed through this quick regenerator as a suspension in a regeneration gas, such as air, at a surface velocity of about 0.5 to 10 m/s, and preferably from 1 to 5 m/s. The ratio height/diameter of this regenerator must be in the range of 3–90 and preferably 10–25. This quick regenerator is equipped with injection nozzles for injecting the regeneration gas at its bottom part (not shown), and over its whole height for optional secondary injections (not shown) of regeneration gases, usually dry air.

The present invention provides a substantial gain with respect to the total volume and bulk of the regenerator, by saving the volumes usually required for the wind box, the distributors, the release zones, the cyclones downwardly extending legs. It also provides for an increase of the contact efficiency between the regeneration gas and the catalyst as a result of the high passage velocity and/or the high ratio height/diameter of reactor (37), improving the distribution and reducing the channeling and the backmixing.

Moreover, the flow, which becomes more similar to piston flow, avoids the segregation of the large particles and the local presence of uncompletely regenerated particles. The control of the post combustion in the second regeneration stage is made easier and it is no longer necessary to use cooling devices with steam or water which, in conventional flowsheets, result in substantial losses of catalyst and in a reduction of their activity, as well as in many damages of the refractory material and of the enclosures.

The regenerated catalyst suspension in combustion gases is laterally discharged through line (38) at a level slightly below the top of the vertical reactor (37), so as to reduce to a minimum the abrasion in said zone where the direction of flow changes by 90° . In line (38) this suspension is accelerated and then separated in the first separation stage (5) which consists of one or more cyclones in parallel, wherein the regeneration gases are separated from the catalyst previously regenerated at high temperature. The compression gases then pass to a second separation stage of high efficiency (6) composed of one or more cyclones, in series or in parallel, according to conventional techniques known in the art.

Cyclonic separators (5) and (6) may be located externally to reactor (37) used for the second regeneration step, so that the problems of high temperature metallurgy are avoided. Combustion gases of high $C0_2$ content are discharged from the cyclonic separation train (5) and (6), through valves maintaining the pressure in the unit, and may then be used to generate process vapor in a heater (not shown).

The catalyst particles are discharged from the second regeneration stage at high temperature with carbon contents preferably lower than 0.04% by weight of the catalyst. The regenerated catalyst, whose temperature is higher than the pseudo-critical temperature of the charge, is fed to the mixer-contactor (11) through the downwardly extending legs (3) and (4) of the separation train (5) and (6). These legs (3) and (4), wherein is maintained a dense flow of powdery solids by means of flow-controlling valves (7) and (8), have a sufficient height to ensure the pressure balance of the unit.

In the contactor-mixer (11), the hot regenerated catalyst is maintained in fluidized state by injections (not shown in FIG. 1) of ventilating gas, such as hydrocarbons of less than 4 carbon atoms, or other suitable gases, such as inert gases. The hot regenerated catalyst, at a temperature higher than the pseudo-critical temperature of the charge, is then discharged through the discharge tubes (10) where it is intimately contacted with the hydrocarbon charge. A catalyst withdrawing line (39) is provided at the lower part of the stripping zone (18); additional fresh catalyst is fed at the level of the first regeneration stage (25) through line (40), in accordance with conventional devices.

FIG. (2) shows more in detail a preferred embodiment of the invention of the device for injecting and dispersing the hydrocarbon charge, at the top of the downwardly extending vertical reactor (101). As already described, the catalyst, regenerated at high temperature, issuing from the second regeneration stage (132) forming an ascending vertical transfer line, reaches the top of reactor (101) through downwardly extending legs (103) and (104) of one (or more in parallel) train(s) of separation formed by external cyclones (105) and (106), provided with valves (107) and (108) for controlling the solids flow. The hot regenerated catalyst is received in an enclosure (located above the horizontal wall 113*a*) where it forms a catalyst bed maintained in dense fluidized state by injection of ventilation gas through at least one distributor (113). This distributor (113), consisting for example of a grid or an assembly of sparge tubes, is conventional in the art. The ventilation gas injected through said distributor (113) consists of inert gases or light hydrocarbons (fuel gas) issuing for example from the downstream fractionation train of the output effluents of the unit (not shown), or any other convenient fluidization mixture or gaseous agent. An optional vapor injection at this level may be performed within limits allowed by the hydrothermal stability of the catalyst regenerated at high temperature, in conformity with the invention. The hot catalyst and the fluidization gas flow downwardly through a plurality of discharge tubes (110).

The liquid hydrocarbon charge, preheated upstream (in a system not shown), to which a certain amount of dispersion vapor can be added, is introduced through a feeding ramp (102) subdivided into a plurality of feeding ducts (109) opening in the discharge tubes (110). These feeding ducts (109) are provided at their end with spray nozzles (114), conventional in the art. The hydrocarbon charge is as finely sprayed as possible in the multinozzle injection system (114) with optional addition of dispersion vapor, to droplets of a size lower than the average granulometry of the regenerated catalyst, i.e. usually smaller than 100 microns and preferably smaller than 90 or even than 50 microns. The hydrocarbon droplets are ejected from the spray nozzles (114) at velocities ranging from 10 to 100 m/s, and accordingly, are subjected to a beginning vaporization at said level.

In the upper portion (zone A) of each of the discharge tubes (110), a central conical jet is formed, which disperses the charge droplets surrounded with a fluid ring of high temperature regenerated catalyst, conveyed by the fluidization gas along the walls of each of the discharge tubes (110). In this upper part (zone A) of each of the discharge tubes (110), simultaneously two substantially parallel flows are generated, respectively of charge droplets and, concentrically, of catalyst regenerated at high temperature. The contact between the two flows is relatively limited in said zone A and the heat transfer between the catalyst particles and the hydrocarbon droplets takes place essentially in a radiating manner, taking advantage of the two-step high temperature regeneration to obtain very quick heat transfer in said zone A. A partial, but already substantial, vaporization is thus achieved at the immediate output of the injection nozzles (114). By this particular mode of heating the droplets jets with flowing solids (catalyst particles) at high temperature, the temperature increase of the charge is very rapid, thus favouring cracking reactions instead of coking reactions. It is important that the droplets size be as small as possible so that the heat exchange process be not limited by the thermal diffusion from the outside to the inside of the droplets. Although the heat exchange is essentially achieved by radiation in said zone A, it is not excluded that other forms of exchange, by conduction and/or convection, take part to the heat transfer.

However, in the injection device, as here described, the heat exchange by radiation is preponderant, at least in zone 1 as above defined. This makes possible a maximum decrease in the formation of conglomerates resulting from the direct contact between hot catalyst particles, acting as solid heat carriers and unvaporized charge droplets.

In the lower part (zone B) of each of the discharge tubes (110), both flows of charge and catalyst are intimately mixed by effect of the dispersion and of the partial vaporization, already substantial, previously effected in zone A, of the droplets of hydrocarbon charge. The contact and intimate mixing, which are desirable at the level of zone B between the catalyst and the hydrocarbon charge, are the more effective as a substantial vaporization of the charge droplets in zone A is effected before. In zone B, in each of the discharge tubes (110), the vaporization of the droplets is completed by intimate mixing and contact with the catalyst regenerated at high temperature. This mixing and this intimate contact are necessary to obtain very quick heat transfers in said zone B. On the other hand, the downward flow avoids backmixing of the catalyst, favours the renewal of the catalyst around the injection nozzles and avoids the formation of a suspension in dense phase at the level of the injection nozzles and in their immediate vicinity, as in ascending reactors feeding systems conventionally used in F.C.C. By reducing to a minimum, with this configuration and as a result of the downward flow, the backmixing at the level of the injection nozzles, the coke formation on the catalyst is substantially reduced, as well as the agglomeration phenomena and the carbon build up, which are detrimental but unavoidable in all the feeding systems of ascending reactors, conventionally used in F.C.C.

Very quick thermal transfers are achieved in both zones A and B, between the catalyst regenerated at high temperature and the finely divided charge droplets. The length of the discharge tubes (110) is so adjusted that the charge/catalyst contact time does not exceed 500 milliseconds and preferentially is shorter than 100 milliseconds. The very quick heat transfer in this convenient mixing device, results, at the level of the charge droplets, in a real initial thermal shock which completely vaporizes the light franctions of the charge, while thermally disintegrating the heavy fractions and the asphaltene structures contained therein. Such an initial thermal shock is necessary and favours the treatment of charges containing substantial amounts of heavy fractions and/or asphaltene structures. It is further observed that the cracking of light fractions is favoured to the prejudice of coking reactions. The downward, multinozzle, quick mixer-contactor type, proposed in this invention, not only provides for the treatment of heavy charges inasmuch as it generates the initial thermal shock, but it also substantially decreases the backmixing phenomena.

At the outlet of the downwardly extending tubes (110), the hydrocarbon vapor/catalyst suspension then flows vertically downwardly through reactor (101) whose cross-section may progressively vary to meet with the required temperature and residence-time operating conditions and to obtain flow conditions close to piston flow.

FIG. 3 shows an adequate embodiment of device for separating the descending reactor effluent from the catalyst driven along with said effluent. The suspension hydrocarbon vapors/catalyst is accelerated in a convergent body (212) whose half apex angle ranges from about 5° to 30° C. and preferably from 7° to 15°, and then enters a primary separator (213). In FIG. 3, the primary separation device comprises only one cyclone with direct passage (213), of the uniflow cyclone type and with tangential input, here arranged horizontally. Other possible embodiments of the invention may comprise a plurality of said cyclones, arranged in parallel, horizontally or vertically. In this type of uniflow cyclone, with direct passage, the helical flow of vapors around the cylindrical, coaxial central core (211), generated by the tangential introduction of said effluent through mouth (210) has the pecularity of being produced without reversal of the generated spiral, in contrast with the conventional reverse flow cyclones. The velocity of the gaseous effluent through the inlet port (210) must range from 10 to 40 m/s in order to generate a real helical flow which, by effect of so-generated centrifugal forces, may flatten the catalyst particles driven therewith against the external wall. The gaseous effluent, so separated from the solid particles, is discharged through the coaxial central duct (209) which penetrates inside the external body (213). The solids are discharged downwardly through the substantially vertical leg (215). This type of cyclone makes possible a relatively short residence time, shorter than one second, a rough primary separation but, nevertheless, with efficiencies higher than 50% and which may reach 90%. In order to improve the efficiency of said primary separation, it is necessary to supply, with the downward flow of solid particles, through the leg (215), a certain amount of the gaseous effluent, which may reach 10% of the total volume flow rate of said effluent. The helical flow, without spiral reversal in this cyclone type with direct passage, not only provides for a quick separation with a residence time shorter than one second but also reduces to a minimum the backmixing phenomena, as a result of the non reversal of the spiral. This quick primary separation thus makes possible to reduce the overcracking phenomena whose negative effects are known as concerns the cracking reactions selectivity. On the other hand, this cyclone for primary separation (213) may only partially penetrate inside the stripping zone (217); this configuration is adapted to a completely external location of reactor (201), with the advantage of making easier the maintenance of said reaction section.

The output (209) might open inside the stripping reactor or zone (217), but it is preferably directly connected, through line (224), to the inlet mouth of secondary separation system (214) comprising one or more stages, in parallel or in series, formed of conventional reverse flow cyclones, known in the art, which then provide for a very thorough separation of the catalyst still driven along with the gaseous effluent to the outlet (209) of the first quick separation stage. Here, the output (209), is directly connected, through line (224), preferably substantially horizontal, to the inlet port of the secondary separation train (214). The stripping reactor (217) is generally equipped, in its upper part, with one or more conventional trains (219) for separating the stripping effluent, comprising one or more separation stages, in parallel and/or in series, consisting of conventional reverse flow cyclones, according to devices known in the art.

Here the outlet (208) of the separation train (214) only discharges the effluents from the reaction section (201), whereas the outlet (207) of the separation train (219) only discharges the effluents from the stripping zone (217). These gaseous effluents outlets (207) and (208) are provided with regulation valves (237) and (238) providing for the control of the pressure balance at the level of the reactor or stripping zone assembly (217).

The stripping reactor (217) is generally flared at its upper part and provided with baffles (220) in the lower part thereof (218) in order to improve the efficiency of the stripping operation. A stripping gas such as steam, inert gases (CO, $C0_2$, $N_2$ . . . ) combustion gases or fuel gases, is injected through a suitable distributor (221) (grid or sparge tubes) at the bottom of the stripping zone.

The stripped catalyst is discharged counter-currently from the reactor (217) through the lower withdrawing duct (239).

What is claimed as this invention is:

1. A process for catalytically cracking a liquid hydrocarbon charge in a fluidized bed reaction zone having an upper and lower part wherein the charge and the catalyst flow co-currently in a downward direction, and for regenerating the catalyst in first and second regeneration zones, said process comprising:

injecting the liquid charge at the upper part of the reaction zone through at least one line which is subdivided into a plurality of substantially vertical first ducts with each of said first ducts being provided at its lower end with spray means for dispensing the liquid charge as droplets, introducing into an enclosure located within the upper part of the reaction zone catalyst particles having a temperature which is in a range from 600° to 950° C., the catalyst particles being introduced through at least one second duct into the enclosure so as to define a catalyst fluidized bed in said enclosure, circulating a gas through said fluidized bed so as to downwardly drive the catalyst particles of the fluidized bed through a plurality of substantially vertical third ducts thereby introducing the catalyst particles into the reaction zone itself, each vertical first duct being coaxial with one of the third ducts, each means for spraying the liquid charge being juxtaposed with an upper end of said third duct, so as to obtain in said third duct a flow of liquid charge and entrained catalyst particles in order to completely vaporize the liquid charge and intimately admix the charge with the catalyst particles, maintaining contact in said reaction zone between the liquid charge and the catalyst, with a residence time of the charge from 0.1 to 10 seconds and at a temperature in the range of 450°-700° C. to produce a reaction effluent stream, increasing the velocity of the catalyst and the reaction effluent in the lower part of the reaction zone, said lower part being funnel shaped and converging downwardly at a half apex angle ranging from about 5 to 30°, separating 50 to 90% of the catalyst particles from the reaction effluent stream in a generated spiral within at least one first separation zone having an inlet and outlet and having a residence time lower than one second, the velocity of the gaseous portion of the reaction effluent at the inlet of said first separation zone being from 10 to 40 meters per second so as to produce a helical flow of vapor without reversal of the generated spiral, with the major part of the remaining catalyst particles being driven along with the gaseous effluent and then being separated from the reaction effluent within at least one second separation zone which includes the reversal of a spiral stream generated by the injection of the gaseous flow into said second separation zone, removing the major part of the hydrocarbons from the catalyst particles by the introduction of a stripping gas, conveying the catalyst particles upwardly through a fourth duct to a first fluidized bed regeneration zone by means of a first carrier gas, performing a first catalyst regeneration step, within said first regeneration zone at a temperature $T_1$ ranging from about 500° to 750° C., with a fluidizing gas which comprises oxygen or a molecular oxygen-containing gas, so as to cause the combustion of at least 90% of the hydrogen and so as to oxidize 10–60% by weight of the carbon present on the catalyst, removing the major part of the gases from the first regeneration zone, withdrawing the partially regenerated catalyst from said first regeneration zone, feeding it upwardly through a first transfer line, by means of a second carrier gas comprising a molecular oxygen-containing gas to a lower part of a second regeneration zone, the second regeneration zone having the shape of a substantially vertical and elongate tube having a length L, and diameter $\phi$, whose ratio L/O ranges from 3 to 90, the catalyst being further regenerated in the second regeneration zone by being treated with the second carrier gas at temperature $T_2$ from 650° to 1000° C., with $T_2$ being higher than $T_1$, in order to obtain a regenerated catalyst containing no more than 0.04% by weight of coke, the catalyst having this been driven upwardly through the second regeneration zone by means of said second carrier gas, and withdrawing from the second regeneration zone a gas-catalyst mixture, separating the catalyst particles from the gases and feeding these regenerated particles, which have a temperature from 600° to 950° C., into said at least one second duct.

2. A process according to claim 1, wherein the second carrier gas is dry air.

3. A process according to claim 1, wherein the charge, before being introduced into the reaction zone, is preheated to a temperature from 350° to 450° C.

4. A process according to claim 3, wherein the catalyst contains at least one zeolite.

5. A process according to claim 3, wherein the second carrier gas is dry air.

6. A process according to claim 1 wherein the catalyst contains at least one zeolite.

7. A process according to claim 6, wherein the second carrier gas is dry air.

8. An apparatus for performing a catalytic cracking and catalyst regeneration process comprising:

a first substantially vertical elongate reactor having an upper and lower part, and a reservoir defined above a horizontal wall located within the upper part, at least one first inlet line for admission of a liquid charge into the upper part of said first reactor, each of said first lines being subdivided into a plurality of substantially vertical first ducts, each first duct being provided at its lower end with a first nozzle for spraying said charge, at least two substantially vertical second inlet lines for introducing the catalyst particles into said reservoir, at least one distributor of a gaseous fluid, located above said horizontal wall, a plurality of catalyst particles discharge tubes connecting said reservoir to said first reactor, said discharge tubes being arranged so that each of the first ducts is coaxial with one of the discharge tubes and so that each first nozzle is located in the vicinity of the upper end of a discharge tube, with all of the first nozzles, first ducts and discharge tubes thus defining a contact and mixing zone for the liquid charge with the catalyst, with the lower part of the reactor including a bottom portion comprising at least one funnel which converges downwardly and has a half apex angle which is in the range from about 5° to 30°, means defining at least one primary separation zone located beneath the funnel including at least one cyclone separator and at least one first outlet line for the removal of the catalyst particles from said primary separation zone, means defining at least one secondary separation zone wherein the reaction effluent is separated from the remaining catalyst particles, including at least one second outlet line for the removal of catalyst particles from said secondary separation zone and at least one third outlet line for the removal of the reaction effluent, means for stripping the catalyst particles by means of a gas introduced through at least one stripping gas inlet line, said means being fed with catalyst through said first and second outlet lines, and a first conduit for conveying catalyst particles discharged from said stripping means, a first substantially vertical transfer line connected to said first conduit for lifting the catalyst particles supplied through said first conduit, by means of a lifting gas thus conveying the catalyst particles to the inside of a first regeneration vessel, the first regeneration vessel comprising means for supporting a catalyst bed, a regeneration gas feeding line, and means comprising at least one cyclone for separating the gases from the catalyst particles, a second duct for discharging gases and a third duct for withdrawing the catalyst from the first regeneration vessel, a second conduit communicating with said third duct for flowing the catalyst downwardly, a second vertical ascending catalyst transfer line connected at a lower end to said second conduit and also to a lifting gas inlet, a second substantially vertical tubular reactor for catalyst regeneration, having a length, L, and diameter, 0, whose ratio L/O ranges from 3 to 90, said second reactor including at least one second nozzle for injecting a regeneration gas, wherein said second reactor is connected to an upper end of said second transfer line, a third conduit for discharging a gas-catalyst mixture from said second reactor and, a first means for separating the catalyst from the gases, the first separation means comprising at least two cyclone separators, and a fourth conduit for conducting the catalyst from said first separation means into said second inlet lines.

9. Apparatus according to claim 8, wherein the distributor consists of a grid or an assembly of sparge tubes.

10. Apparatus according to claim 9, wherein the secondary separation zone comprises a plurality of separation stages which each include at least one reverse flow cyclone.

11. Apparatus according to claim 8, wherein said reaction vessel further includes a plurality of regeneration gas inlet lines which are located at different vertical levels within the vessel.

12. Apparatus according to claim 11, wherein the secondary separation zone comprises a plurality of separation stages which each include at least one reverse flow cyclone.

13. Apparatus according to claim 12, wherein said stripping means includes a lower portion which has a downwardly converging shape and a upper portion which includes a second separation means, said second separation means comprising a train of at least two separation stages, with each of said stages including a cyclone separator and wherein each of said cyclones includes a first outlet duct which is in fluid communication with said secondary separation zone, said stripping means further comprises a third separation means which includes a second outlet duct which discharges the stripping gases and the gases removed from the catalyst particles from the third separation means.

14. Apparatus according to claim 11, wherein the distributor consists of a grid or an assembly of sparge tubes.

15. Apparatus according to claim 8, wherein the secondary separation zone comprises a plurality of separation stages which each include at least one reverse flow cyclone.

16. Apparatus according to claim 15, wherein said stripping means includes a lower portion which has a downwardly converging shape and an upper portion which includes a second separation means, said second separation means comprising a train of at least two separation stages, with each of said stages including a cyclone separator and wherein each of said cyclones includes a first outlet duct which is in fluid communication with said secondary separation zone, said stripping means further comprises a third separation means which includes a second outlet duct which discharges the stripping gases and the gases removed from the catalyst particles from the third separation means.

17. Apparatus according to claim 10, wherein said stripping means includes a lower portion which has a downwardly converging shape and an upper portion which includes a second separation means, said second separation means comprising a train of at least two separation stages, with each of said cyclones includes a first outlet duct which is in fluid communication with said secondary separation zone, said stripping means further comprises a third separation means which includes a second outlet duct which discharges the stripping gases and the gases removed from the catalyst particles from the third separation means.

* * * * *